US008046988B2

(12) United States Patent
Heebink et al.

(10) Patent No.: US 8,046,988 B2
(45) Date of Patent: Nov. 1, 2011

(54) SYSTEM HAVING MULTIPLE VALVES OPERATED BY COMMON CONTROLLER

(75) Inventors: Andrew C. Heebink, Chillicothe, IL (US); John D. Gierszewski, Creve Coeur, IL (US)

(73) Assignee: Caterpillar Inc., Peoria, IL (US)

( * ) Notice: Subject to any disclaimer, the term of this patent is extended or adjusted under 35 U.S.C. 154(b) by 1488 days.

(21) Appl. No.: 11/412,986

(22) Filed: Apr. 28, 2006

(65) Prior Publication Data

US 2007/0199306 A1 Aug. 30, 2007

Related U.S. Application Data

(60) Provisional application No. 60/777,245, filed on Feb. 28, 2006.

(51) Int. Cl.
*F01N 3/00* (2006.01)

(52) U.S. Cl. ..... 60/297; 60/274; 60/286; 60/295; 60/324; 431/12; 431/14

(58) Field of Classification Search ..... 60/274, 60/286, 295, 297, 324; 431/3, 6, 10, 12, 431/14, 15

See application file for complete search history.

(56) References Cited

U.S. PATENT DOCUMENTS

| | | | | |
|---|---|---|---|---|
| 2,700,301 | A | 1/1955 | Thomsen | |
| 4,581,891 | A * | 4/1986 | Usui et al. | 60/286 |
| 4,859,171 | A * | 8/1989 | Altemark et al. | 431/12 |
| 5,263,851 | A * | 11/1993 | Hosome et al. | 431/79 |
| 5,277,025 | A * | 1/1994 | Gonze et al. | 60/274 |
| 5,711,149 | A * | 1/1998 | Araki | 60/278 |
| 5,921,883 | A | 7/1999 | Bellinger | |
| 6,516,786 | B2 * | 2/2003 | Krimmer et al. | 123/520 |
| 6,652,265 | B2 * | 11/2003 | Cain | 431/6 |
| 6,766,828 | B2 | 7/2004 | Takada et al. | |
| 6,953,492 | B2 | 10/2005 | Callahan | |
| 7,037,349 | B2 * | 5/2006 | Dauer et al. | 48/214 A |
| 7,523,762 | B2 * | 4/2009 | Buezis et al. | 137/613 |
| 7,584,625 | B2 * | 9/2009 | Wu et al. | 62/228.1 |
| 2001/0036413 | A1 | 11/2001 | McFadden et al. | |
| 2004/0208754 | A1 | 10/2004 | McFadden et al. | |

FOREIGN PATENT DOCUMENTS

| | | |
|---|---|---|
| JP | 54025379 | 2/1979 |
| WO | WO 01/73300 | 10/2001 |

* cited by examiner

*Primary Examiner* — Tu Nguyen

(74) *Attorney, Agent, or Firm* — Finnegan, Henderson, Farabow, Garrett & Dunner LLP

(57) ABSTRACT

A control system for a power system is disclosed. The control system has a first valve mechanism, a second valve mechanism, and a controller in communication with the first and second valve mechanisms. The controller is configured to direct a single electronic control signal to the first and second valve mechanisms. Actuation of the first valve mechanism is initiated in response to the value of the single electronic control signal exceeding a first threshold value, and actuation of the second valve mechanism is initiated in response to the value of the single electronic control signal exceeding a second threshold value.

23 Claims, 2 Drawing Sheets

SYSTEM HAVING MULTIPLE VALVES OPERATED BY COMMON CONTROLLER

RELATED APPLICATIONS

This application is based upon and claims the benefit of priority from U.S. Provisional Application No. 60/777,245 by Andrew HEEBINK et al., filed Feb. 28, 2006, the contents of which are expressly incorporated herein by reference.

TECHNICAL FIELD

The present disclosure is directed to a fluid control system and, more particularly, to a fluid control system having multiple valves operated by a common controller via a single output.

BACKGROUND

Fluid handling systems often employ multiple valves that cooperate to perform related functions. For example, in a hydraulic system having a source of fluid pressure, multiple electronically controlled valves are often used to selectively load and unload the source or direct pressurized fluid from the source to one or more actuators. Each of the electronically controlled valves requires an associated driver and driver circuitry to control the function of the valve elements. This large number of drivers and driver circuitry can be expensive, complex, and increase the unreliability of the fluid handling system. In addition, when retrofitting an existing system with updated components, the existing system may not have the appropriate number of drivers and driver circuitry required to adequately support the additional components.

One way to simplify such a hydraulic system is described in U.S. Patent Application Publication No. 2004/0208754 (the '754 publication) published on Oct. 21, 2004 to McFadden et al. The '754 publication describes an electromechanical control system comprising a single input, dual adjustable output driver that can provide two separate control signals to load or unload two associated hydraulic implement pumps. In other words, the electromechanical control system can determine the speed of the pumps and, through separate control of the operation of two valves, open or close oil flow to a reservoir, thereby providing pressure and flow to the hydraulic system or recirculating oil back to an inlet of the two pumps.

Although the electromechanical control system of the '754 patent may simplify the associated hydraulic implement system, it may still be complex and expensive. In particular, although a single driver may be used to control operation of two separate valves, separate driver circuitry for each of the valves is still required. In addition, the driver is still required to output separate control signals to control each valve individually. This additional circuitry and complexity may increase the cost of the electromechanical control system.

The fluid control system of the present disclosure solves one or more of the problems set forth above.

SUMMARY OF THE INVENTION

One aspect of the present disclosure is directed to a control system. The control system includes a first valve mechanism, a second valve mechanism, and a controller in communication with the first and second valve mechanisms. The controller is configured to direct a single electronic control signal to the first and second valve mechanisms. Actuation of the first valve mechanism is initiated in response to the value of the single electronic control signal exceeding a first threshold value, and actuation of the second valve mechanism is initiated in response to the value of the single electronic control signal exceeding a second threshold value.

Another aspect of the present disclosure is directed to a method of controlling a hydraulic system. The method includes directing pressurized fluid to a first valve mechanism and a second valve mechanism. The method also includes sending a single electronic control signal to the first and second valve mechanisms. Actuation of the first valve mechanism is initiated in response to the value of the single electronic control signal exceeding a first threshold value, and actuation of the second valve mechanism is initiated in response to the value of the single electronic control signal exceeding a second threshold value.

DETAILED DESCRIPTION

Figure 1:
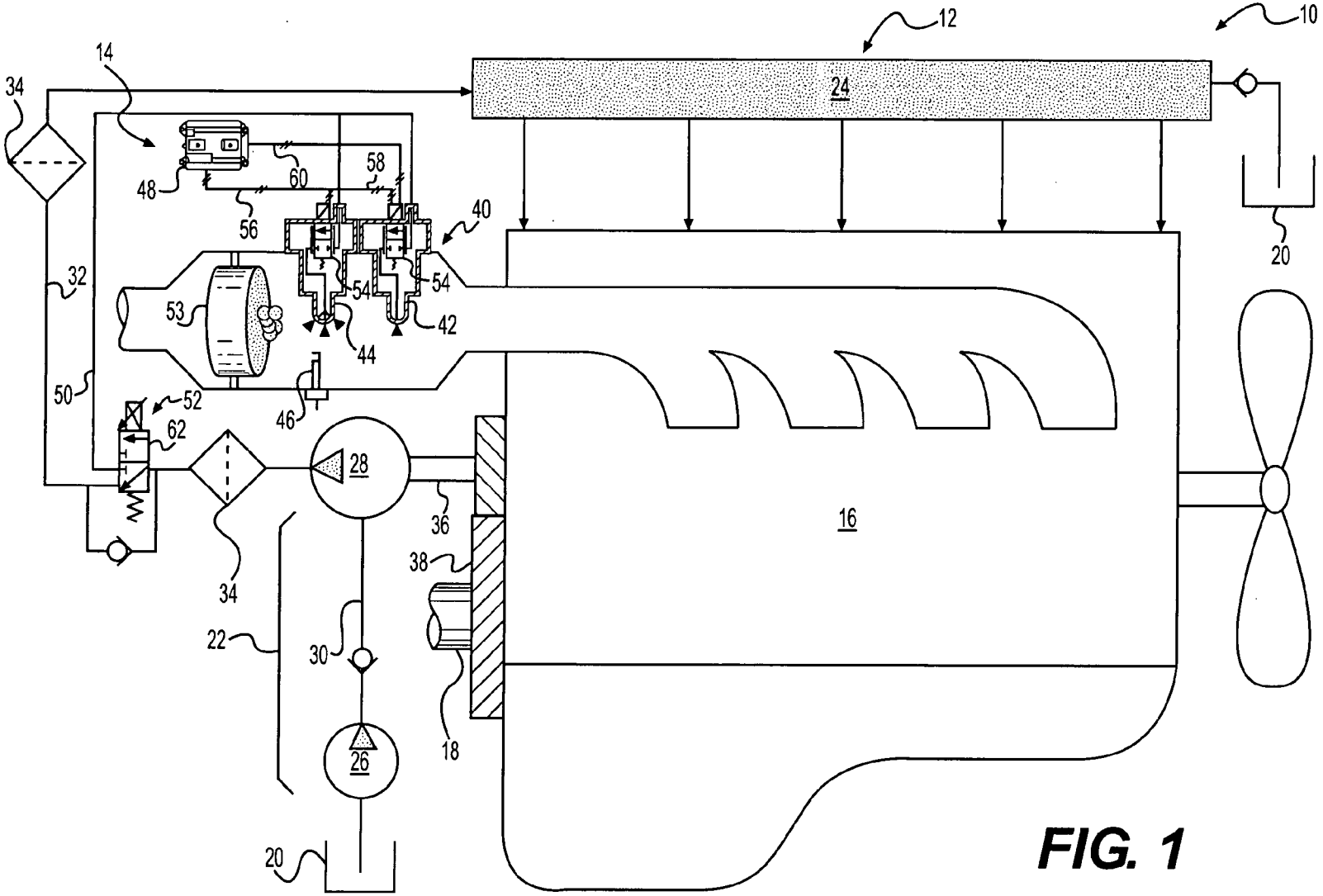
FIG. 1 is a schematic and diagrammatic illustration of an exemplary disclosed power system.

FIG. 1 illustrates a power system 10 having a common rail fuel system 12 and an auxiliary regeneration system 14. For the purposes of this disclosure, power system 10 is depicted and described as a four-stroke diesel engine. One skilled in the art will recognize, however, that power system 10 may be any other type of internal combustion engine such as, for example, a gasoline or a gaseous fuel-powered engine. Power system 10 may include an engine block 16 that at least partially defines a plurality of combustion chambers (not shown). In the illustrated embodiment, power system 10 includes four combustion chambers. However, it is contemplated that power system 10 may include a greater or lesser number of combustion chambers and that the combustion chambers may be disposed in an "in-line" configuration, a "V" configuration, or any other suitable configuration.

As also shown in FIG. 1, power system 10 may include a crankshaft 18 that is rotatably disposed within engine block 16. A connecting rod (not shown) may connect a plurality of pistons (not shown) to crankshaft 18 so that a sliding motion of each piston within the respective combustion chamber results in a rotation of crankshaft 18. Similarly, a rotation of crankshaft 18 may result in a sliding motion of the pistons.

Common rail fuel injection system 12 may include components that cooperate to deliver injections of pressurized fuel into each of the combustion chambers. Specifically, common rail fuel injection system 12 may include a tank 20 configured to hold a supply of fuel, and a fuel pumping arrangement 22 configured to pressurize the fuel and direct the pressurized fuel to a plurality of fuel injectors (not shown) by way of a common rail 24.

Fuel pumping arrangement 22 may include one or more pumping devices that function to increase the pressure of the fuel and direct one or more pressurized streams of fuel to common rail 24. In one example, fuel pumping arrangement 22 includes a low pressure source 26 and a high pressure source 28 disposed in series and fluidly connected by way of a fuel line 30. Low pressure source 26 may embody a transfer pump configured to provide low pressure feed to high pressure source 28. High pressure source 28 may be configured to receive the low pressure feed and increase the pressure of the fuel to the range of about 30-300 MPa. High pressure source 28 may be connected to common rail 24 by way of a fuel line 32. One or more filtering elements 34, such as a primary filter and a secondary filter, may be disposed within fuel line 32 in series relation to remove debris and/or water from the fuel pressurized by fuel pumping arrangement 22.

One or both of low and high pressure sources 26, 28 may be operably connected to power system 10 and driven by crankshaft 18. Low and/or high pressure sources 26, 28 may be connected with crankshaft 18 in any manner readily apparent to one skilled in the art where a rotation of crankshaft 18 will result in a corresponding driving rotation of a pump shaft. For example, a pump driveshaft 36 of high pressure source 28 is shown in FIG. 1 as being connected to crankshaft 18 through a gear train 38. It is contemplated, however, that one or both of low and high pressure sources 26, 28 may alternatively be driven electrically, hydraulically, pneumatically, or in any other appropriate manner.

Auxiliary regeneration system 14 may be associated with an exhaust treatment device 40. In particular, as exhaust from power system 10 flows through exhaust treatment device 40, particulate matter may be removed from the exhaust flow by wire mesh or ceramic honeycomb filtration media 53. Over time, the particulate matter may build up in filtration media 53 and, if left unchecked, the particulate matter buildup could be significant enough to restrict, or even block the flow of exhaust through exhaust treatment device 40, allowing for backpressure within the power system 10 to increase. An increase in the backpressure of power system 10 could reduce the system's ability to draw in fresh air, resulting in decreased performance, increased exhaust temperatures, and poor fuel consumption. Auxiliary regeneration system 14 may include components that cooperate to periodically reduce the buildup of particulate matter within exhaust treatment device 40. These components may include, among other things, a pilot injector 42, a main injector 44, a spark plug 46, and an associated controller 48. It is contemplated that auxiliary regeneration system 14 may include additional or different components such as, for example, an air induction system, a pressure sensor, a temperature sensor, a flow sensor, a flow blocking device, and other components known in the art.

Pilot and main injectors 42, 44 may be disposed within a housing of exhaust treatment device 40 and connected to fuel line 32 by way of a fluid passageway 50 and a main control valve 52. Each of pilot and main injectors 42, 44 may be operable to inject an amount of pressurized fuel into exhaust treatment device 40 at predetermined timings, fuel pressures, and fuel flow rates. The timing of fuel injection into exhaust treatment device 40 may be synchronized with sensory input received from a temperature sensor (not shown), one or more pressure sensors (not shown), a timer (not shown), or any other similar sensory devices such that the injections of fuel substantially correspond with a buildup of particulate matter within exhaust treatment device 40. For example, fuel may be injected as a pressure of the exhaust flowing through exhaust treatment device 40 exceeds a predetermined pressure level or a pressure drop across filtration media 53 of exhaust treatment device 40 exceeds a predetermined differential value. Alternatively or additionally, fuel may be injected as the temperature of the exhaust flowing through exhaust treatment device 40 exceeds a predetermined value. It is also contemplated that fuel may also be injected on a set periodic basis, in addition to or regardless of pressure or temperature conditions, if desired.

Each of pilot and main injectors 42, 44 may include an electronically controlled proportional valve element 54 that is solenoid movable against a spring bias in response to a commanded flow rate. Valve element 54 may be movable between a first position at which pressurized fuel may spray into exhaust treatment device 40, and a second position at which fuel may be blocked from exhaust treatment device 40. Valve element 54 may be moved to any position between the first and second positions to vary the rate of fuel flow into exhaust treatment device 40. Valve elements 54 may be connected to controller 48 in series relation via a first, second, and third communication line 56, 58, 60 to receive an electronic signal indicative of the commanded flow rates.

Similar to pilot and main injectors 42, 44, main control valve 52 may also include an electronically controlled valve element 62 that is solenoid movable against a spring bias in response to a commanded flow rate. Valve element 62 may be movable from a first position at which pressurized fuel may be directed to common rail 24, to a second position at which fuel may be directed to auxiliary regeneration system 14. Valve element 62 may be connected to controller 48 to receive electronic signals indicative of which of the first and second positions is desired.

Spark plug 46 may facilitate ignition of fuel sprayed from pilot and main injectors 42, 44 into exhaust treatment device 40 during a regeneration event. Specifically, during a regeneration event, the temperature of the exhaust exiting power system 10 may be too low to cause auto-ignition of the particulate matter trapped within exhaust treatment device 40 or of the fuel sprayed from pilot and main injectors 42, 44. To initiate combustion of the fuel and, subsequently, the trapped particulate matter, a small quantity of fuel from pilot injector 42 may be sprayed or otherwise injected toward spark plug 46 to create a locally rich atmosphere readily ignitable by spark plug 46. A spark developed across electrodes of spark plug 46 may ignite the locally rich atmosphere creating a flame, which may be jetted or otherwise advanced toward the main injection of fuel from main injector 44. The flame jet propagating from pilot injector 42 may raise the temperature within exhaust treatment device 40 to a level which readily supports efficient ignition of the larger injection of fuel from main injector 44. As the fuel sprayed from main injector 44 ignites, the temperature within exhaust treatment device 40 may continue to rise to a level that causes ignition of the particulate matter trapped within filtration media 53 of exhaust treatment device 40, thereby regenerating exhaust treatment device 40.

In order to accomplish these specific injection events, controller 48 may control operation of pilot and main injectors 42, 44 in response to one or more inputs. In particular, controller 48 may be configured to regulate a fuel injection timing, pressure, and/or amount by directing a predetermined current waveform or sequence of predetermined current waveforms to each of pilot and main injectors 42, 44 via communication lines 56, 58. For the purposes of this disclosure, the combination of current levels directed through communication lines 56, 58 to valve elements 54 that produce the desired injections of fuel during a single regeneration event may be considered a current waveform.

Controller 48 may embody a single microprocessor or multiple microprocessors that include a means for controlling an operation of pilot and main injectors 42, 44. Numerous commercially available microprocessors can be configured to perform the functions of controller 48. It should be appreciated that controller 48 could readily embody a general power system microprocessor capable of controlling numerous different functions of power system 10. Controller 48 may include components required to run an application such as, for example, a memory, a secondary storage device, and a processor, such as a central processing unit or any other means known in the art. Various other known circuits may be associated with controller 48, including power supply circuitry, signal-conditioning circuitry, solenoid driver circuitry, communication circuitry, and other appropriate circuitry.

Figure 2:
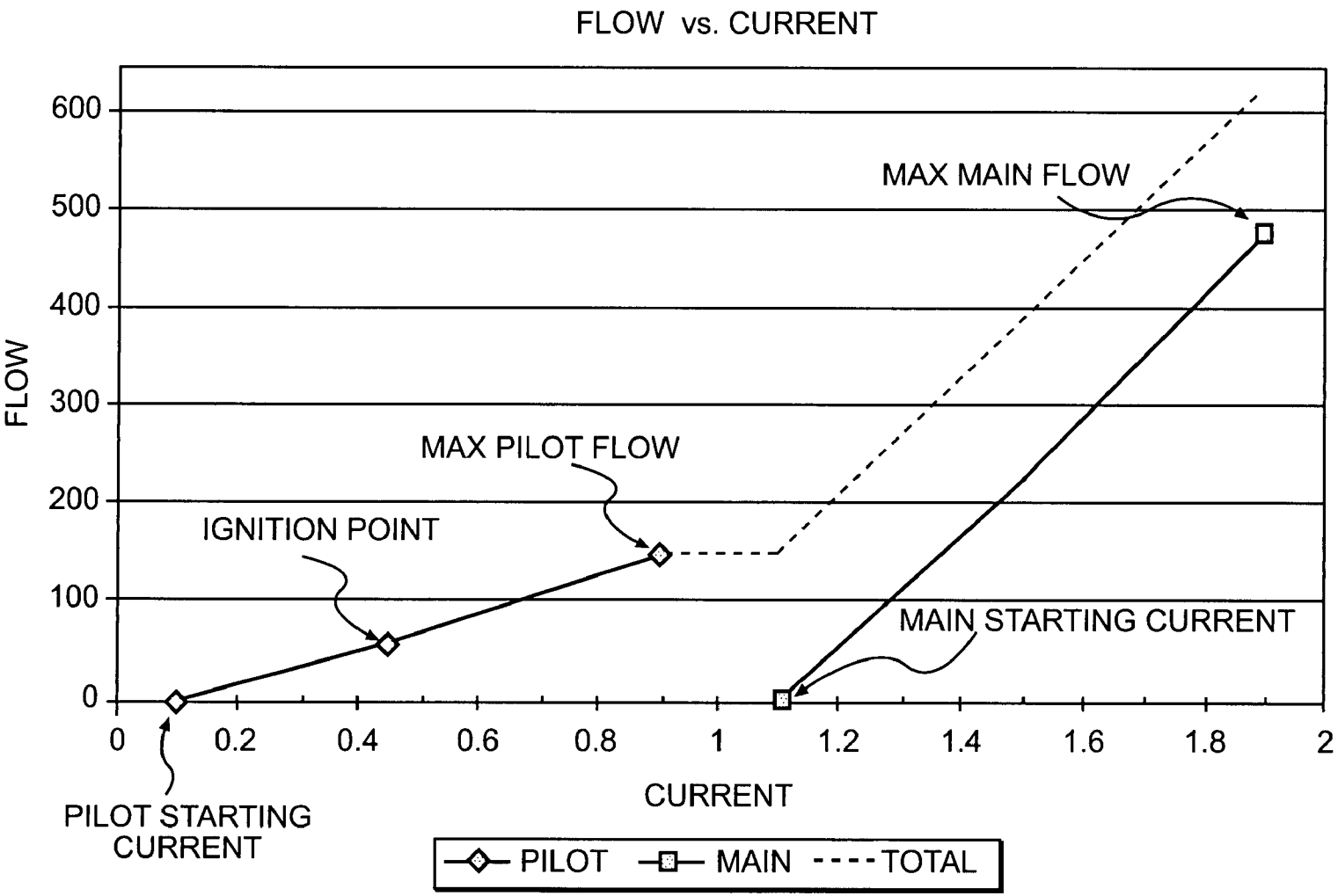
FIG. 2 is a graph illustrating an exemplary operation of a fluid control system associated with the power system of FIG. 1.

FIG. 2 illustrates a graph depicting an exemplary operation of power system 10. FIG. 2 will be discussed in the following section to further illustrate the disclosed system and its operation.

INDUSTRIAL APPLICABILITY

The fluid control system of the present disclosure may be applicable to a variety of hydraulic circuit configurations including, for example, fuel injection systems, particulate regeneration systems, work machine implement systems, and other similar hydraulic circuit configurations known in the art. The disclosed fluid control system may be implemented into any hydraulic circuit configuration that utilizes multiple valve mechanisms where limited driver output is available or reduced driver output and associated driver circuitry is desired. The operation of power system 10 will now be explained.

Referring to FIG. 1, air and fuel may be drawn into the combustion chambers of power system 10 for subsequent combustion. Specifically, fuel from common rail fuel system 12 may be injected into the combustion chambers of power system 10, mixed with the air therein, and combusted by power system 10 to produce a mechanical work output and an exhaust flow of hot gases. The exhaust flow may contain a complex mixture of air pollutants composed of gaseous and solid material, which includes particulate matter. As this particulate laden exhaust flow is directed from the combustion chambers through exhaust treatment device 40, particulate matter may be strained from the exhaust flow by filtration media 53. Over time, the particulate matter may build up in filtration media 53 and, if left unchecked, the buildup could be significant enough to restrict, or even block the flow of exhaust through exhaust treatment device 40. As indicated above, the restriction of exhaust flow from power system 10 may increase the backpressure of power system 10 and reduce the system's ability to draw in fresh air, resulting in decreased performance of power system 10, increased exhaust temperatures, and poor fuel consumption.

To prevent the undesired buildup of particulate matter within exhaust treatment device 40, filtration media 53 may be regenerated. Regeneration may be periodic or based on a triggering condition such as, for example, a lapsed time of engine operation, a pressure differential measured across filtration media 53, a temperature of the exhaust flowing from power system 10, or any other condition known in the art.

Controller 48 may be configured to initiate regeneration. In particular, controller 48 may send a single driver output via communication line 56 to both pilot and main injectors 42, 44 that causes pilot and main injectors 42, 44 to selectively pass fuel into exhaust treatment device 40 at a desired rate. As the fuel from pilot injector 42 sprays into exhaust treatment device 40, a spark from spark plug 46 may ignite the pilot flow of fuel. As the larger flow of fuel from main injector 44 is injected into exhaust treatment device 40, the ignited pilot flow of fuel may ignite the larger flow of fuel. The ignited larger flow of fuel may then raise the temperature of the particulate matter trapped within filtration media 53 to the combustion level of the entrapped particulate matter, burning away the particulate matter and, thereby, regenerating filtration media 53.

As illustrated in FIG. 2, the passing of fuel from pilot and main injectors 42, 44 into exhaust treatment device 40 may be initiated in response to a current of the driver output from controller 48. Specifically, the driver output or control signal from controller 48 may embody a waveform having a varying current level. As the current supplied to pilot injector 42 reaches a first predetermined threshold value, about 0.1 amps in the example of FIG. 2, valve element 54 may be moved away from the flow blocking position toward the flow passing position to initiate the injection of pilot fuel into exhaust treatment device 40. As the current supplied to pilot injector 42 continues to increase beyond the first threshold value, the flow of fuel from pilot injector 42 may correspondingly increase until valve element 54 moves to a maximum flow passing position at about 0.9 amps. As the current supplied to pilot injector 42 increases from about 0.4 amps to about 0.5 amps, a current may be supplied to spark plug 46 causing it to ignite the pilot flow of fuel. During movement or modulation of valve element 54 of pilot injector 42, valve element 54 of main injector 44 may remain stationary in the flow blocking position.

As the current supplied to both pilot and main injectors 42, 44 continues to increase and exceeds a second predetermined threshold value, about 1.1 amps in the example of FIG. 2, valve element 54 of main injector 44 may be moved away from the flow blocking position toward the flow passing position to initiate the larger or main injection of fuel from main injector 44 into exhaust treatment device 40. As the current supplied to main injector 44 continues to increase beyond the second threshold value, the flow of fuel from main injector 44 may proportionally increase until valve element 54 of main injector 44 moves to a maximum flow passing position at about 1.9 amps. During movement of valve element 54 of main injector 44, valve element 54 of pilot injector 42 may remain stationary in its maximum flow passing position.

The disclosed fluid control system may be simple and inexpensive. In particular, because a single controller with a single output may be used to control the operation of two separate valves, the driver circuitry associated with control of pilot and main injectors 42, 44 may be minimal. In addition, because controller 48 is only required to produce a single output control signal, it may be a less expensive controller than other available controllers that are capable of producing multiple output control signals. This reduced circuitry and increased simplicity may lower the cost of power system 10, and facilitate the retrofitting of auxiliary regeneration system 14 to existing power systems that have limited control output capacity.

It will be apparent to those skilled in the art that various modifications and variations can be made to the fluid control system of the present disclosure without departing from the scope of the disclosure. Other embodiments will be apparent to those skilled in the art from consideration of the specification and practice of the fluid control system disclosed herein. It is intended that the specification and examples be considered as exemplary only, with a true scope of the disclosure being indicated by the following claims and their equivalents.

What is claimed is:

1. A method of controlling a hydraulic system, comprising:

directing pressurized fluid to a first valve mechanism;

directing pressurized fluid to a second valve mechanism;

sending a single electronic control signal to the first and second valve mechanisms;

activation of the first valve mechanism in response to the value of the single electronic control signal exceeding a first threshold value;

activation of the second valve mechanism in response to the value of the single electronic control signal exceeding a second threshold value; and maintaining the first valve mechanism in an activated state during activation of the second valve mechanism.

2. The method of claim 1, wherein maintaining the first valve mechanism in an activated state includes maintaining the first valve mechanism at a maximum activation set point.

3. The method of claim 1, further including maintaining the second valve mechanism in a deactivated state during initiation of activation of the first valve mechanism.

4. The method of claim 1, wherein the second threshold value is greater than the first.

5. The method of claim 4, further including maintaining the first valve mechanism in the activated state as long as the value of the single electronic control signal remains above the first threshold value.

6. A control system, comprising:

a first valve mechanism;

a second valve mechanism; and a controller in communication with the first and second valve mechanisms, the controller being configured to direct a single electronic control signal to activate the first and second valve mechanisms, wherein activation of the first valve mechanism is initiated in response to the value of the single electronic control signal exceeding a first threshold value, and activation of the second valve mechanism is initiated in response to the value of the single electronic control signal exceeding a second threshold value, wherein the first valve mechanism remains activated when the second valve mechanism is activated.

7. The control system of claim 6, wherein the single electronic control signal includes a variable current waveform directed from the controller to the first and second valve mechanisms.

8. The control system of claim 6, wherein the second valve mechanism is not activated during initiation of activation of the first valve mechanism.

9. The control system of claim 6, wherein the first and second valve mechanisms are electrically connected in series relationship.

10. The control system of claim 6, wherein the second threshold value is greater than the first.

11. The control system of claim 10, wherein the first valve mechanism remains activated when the single electronic control signal has any value greater than the first threshold value.

12. The control system of claim 6, wherein each of the first and second valve mechanisms include a valve element movable between a flow passing position and a flow blocking position.

13. The control system of claim 12, wherein the first and second valve mechanisms are considered activated when their respective valve elements are in the flow passing positions.

14. The control system of claim 13, wherein the valve elements of the first and second valve mechanisms are proportional valve elements and are movable to any position between the flow passing and flow blocking positions to vary a flow rate of fluid through the valve elements.

15. The control system of claim 14, wherein the valve element of the first valve mechanism is in a maximum flow passing position before the value of the single electronic control signal has increased to the second threshold value.

16. A power system, comprising:

an engine configured to generate a power output and a flow of exhaust;

an exhaust treatment device configured to receive the flow of exhaust and strain particulate matter from the flow of exhaust;

a source of pressurized fuel;

a first proportional valve mechanism in communication with the source and configured to selectively pass a first flow of pressurized fuel to and block the first flow of pressurized fuel from the exhaust treatment device;

a second proportional valve mechanism in communication with the source and electrically connected in series relationship with the first proportional valve mechanism, the second proportional valve mechanism being configured to selectively pass a second flow of pressurized fuel to and block the second flow of pressurized fuel from the exhaust treatment device; and a controller in communication with the first and second proportional valve mechanisms, the controller being configured to direct a single electronic control signal having a varying current level to the first and second proportional valve mechanisms, wherein activation of the first proportional valve mechanism to pass of the first flow of pressurized fuel is initiated to when the current of the single electronic control signal exceeds a first threshold value, and activation of the second proportional valve mechanism to pass the second flow of pressurized fuel is initiated when the current of the single electronic control signal exceeds a second threshold value higher than the first threshold value.

17. The power system of claim 16, wherein the second proportional valve mechanism is not activated during initiation of activation of the first proportional valve mechanism.

18. The power system of claim 16, wherein:

the first proportional valve mechanism passes the first flow of pressurized fuel to the exhaust treatment device anytime the single electronic control signal has a current over the first threshold value; and the first flow of pressurized fuel is passed to the exhaust treatment device any time the second flow of pressurized fuel is passed to the exhaust treatment device.

19. The power system of claim 18, wherein the first proportional valve mechanism is in a maximum flow passing position before the value of the single control signal has increased to the second threshold value.

20. The power system of claim 16, further including a spark plug configured to ignite the first flow of pressurized fuel.

21. The power system of claim 20, wherein the first flow of pressurized fuel has a maximum flow rate less than a maximum flow rate of the second flow of pressurized fuel.

22. The power system of claim 21, wherein the ignited first flow of pressurized fuel is configured to ignite the second flow of pressurized fuel.

23. The power system of claim 22, wherein the ignited second flow of pressurized fuel is configured to burn the strained particulate matter.

* * * * *

UNITED STATES PATENT AND TRADEMARK OFFICE

CERTIFICATE OF CORRECTION

PATENT NO. : 8,046,988 B2
APPLICATION NO. : 11/412986
DATED : November 1, 2011
INVENTOR(S) : Heebink et al.

It is certified that error appears in the above-identified patent and that said Letters Patent is hereby corrected as shown below:

In the Claims

Column 8, line 24, in Claim 16, delete "to pass of the first" and insert -- to pass the first --.

Column 8, line 25, in Claim 16, delete "initiated to when" and insert -- initiated when --.

Signed and Sealed this
Twenty-first Day of July, 2015

Michelle K. Lee

Michelle K. Lee
*Director of the United States Patent and Trademark Office*